US012366041B1

(12) United States Patent
Fuller

(10) Patent No.: US 12,366,041 B1
(45) Date of Patent: Jul. 22, 2025

(54) TEMPORARY ROADWAY ASSEMBLIES AND METHODS

(71) Applicant: John Thompson Fuller, Brierfield, AL (US)

(72) Inventor: John Thompson Fuller, Brierfield, AL (US)

( * ) Notice: Subject to any disclaimer, the term of this patent is extended or adjusted under 35 U.S.C. 154(b) by 794 days.

(21) Appl. No.: 17/699,356

(22) Filed: Mar. 21, 2022

(51) Int. Cl.
*E01C 9/08* (2006.01)

(52) U.S. Cl.
CPC ..... *E01C 9/086* (2013.01)

(58) Field of Classification Search
CPC ... E01C 9/08; E01C 9/086; E01C 5/12; E01C 5/18; E01C 5/20; E01C 5/22; E01C 5/223; E01C 5/226; E01C 13/045; E01C 9/00
See application file for complete search history.

(56) References Cited

U.S. PATENT DOCUMENTS 1,142,727 A * 6/1915 Pottsgrove ..... B60B 39/12 238/14
1,815,435 A * 7/1931 Harding ..... B60B 39/12 238/14
2,369,412 A 2/1945 Ruppel
3,672,422 A * 6/1972 Greipel ..... B60B 39/12 238/14
3,701,474 A * 10/1972 Welz ..... B60B 39/12 238/14
4,681,482 A * 7/1987 Arciszewski ..... E01C 19/522 238/14
4,998,670 A 3/1991 Peterson
5,050,366 A 9/1991 Gardner
5,131,787 A * 7/1992 Goldberg ..... E01C 9/086 428/903.3
5,204,159 A * 4/1993 Tan ..... E01C 5/20 4/581
5,538,183 A * 7/1996 McGee ..... B60B 39/12 238/14
6,080,460 A * 6/2000 Chapman ..... E01C 9/086 52/DIG. 9
6,779,738 B1 * 8/2004 Stannard ..... B60B 39/12 238/14
6,874,972 B2 4/2005 Davis
7,210,876 B2 5/2007 Moralez
7,364,383 B2 4/2008 Fletcher et al.
(Continued)

*Primary Examiner* — Abigail A Risic
(74) *Attorney, Agent, or Firm* — R. Keith Harrison

(57) ABSTRACT

Temporary roadway assemblies may include a plurality of runner members. Each runner member may include a base panel having a base panel outer surface and a base panel inner surface. A ground traction surface may be disposed at the base panel inner surface. At least one ground traction element may be provided at the ground traction surface. The ground traction element may be configured to engage the ground surface and facilitate traction of each corresponding runner member with respect to the ground surface. A vehicle traction surface may be disposed at the base panel outer surface. At least one vehicle traction element may be provided at the vehicle traction surface. The vehicle traction element may be configured to facilitate traction between vehicle wheels on the vehicles and each corresponding runner member. A plurality of runner member connectors may be configured to connect adjacent ones of the plurality of runner members.

16 Claims, 15 Drawing Sheets

(56) References Cited

U.S. PATENT DOCUMENTS

| | | | | |
|---|---|---|---|---|
| 7,427,172 | B2 * | 9/2008 | Lukasik | E01C 9/086 404/34 |
| 7,546,654 | B2 * | 6/2009 | Carmel | E04B 1/3205 14/2.4 |
| 8,210,443 | B2 * | 7/2012 | Studstill | B60B 39/00 238/14 |
| 8,448,877 | B1 * | 5/2013 | Aubin | B60C 27/00 238/14 |
| 8,784,002 | B2 * | 7/2014 | Ringus | E01C 19/522 404/46 |
| 8,827,173 | B2 * | 9/2014 | Nutzati | B60B 39/12 238/14 |
| 9,701,160 | B2 * | 7/2017 | Dagrossa | B60B 39/12 |
| 9,878,579 | B2 * | 1/2018 | Rosier | B60B 39/12 |
| 9,957,672 | B2 * | 5/2018 | Rosier | E01C 9/086 |
| 10,023,008 | B2 * | 7/2018 | Dagrossa | E01C 9/00 |
| 2006/0222804 | A1 * | 10/2006 | Banting | E01C 9/086 428/54 |
| 2012/0321382 | A1 * | 12/2012 | Rosier | E01C 9/086 404/35 |
| 2015/0361624 | A1 * | 12/2015 | Rosier | E01C 11/16 404/35 |
| 2016/0326700 | A1 * | 11/2016 | Ochoa | E01C 9/086 |
| 2017/0174000 | A1 * | 6/2017 | Dagrossa | B60B 39/12 |
| 2017/0268182 | A1 * | 9/2017 | Wigley | E01C 19/522 |
| 2018/0281518 | A1 * | 10/2018 | Joyce | B60B 39/12 |
| 2019/0070901 | A1 * | 3/2019 | Otero | B60B 39/12 |

* cited by examiner

TEMPORARY ROADWAY ASSEMBLIES AND METHODS

FIELD

Illustrative embodiments of the disclosure generally relate to mats and the like for deployment on a ground surface to facilitate traversal of vehicles on the surface. More particularly, illustrative embodiments of the disclosure relate to temporary roadway assemblies which are durable, capable of multiple uses and can be easily stored, transported and deployed on a ground surface to support and provide optimum traction to vehicles as the vehicles traverse the surface.

BACKGROUND

The background description provided herein is solely for the purpose of generally presenting the context of the illustrative embodiments of the disclosure. Aspects of the background description are neither expressly nor impliedly admitted as prior art against the claimed subject matter.

As they leave a logging deck typically in transit to a mill, log trucks loaded with logs may cause ruts in the ground surface which they traverse. Typically, in the wintertime, roads may be 80%-90% hard with little rutting. In those few areas of the ground in which ruts may have a tendency to form, however, large mats or runners may need to be deployed on the ground surface to keep the wheels of the trucks from sinking down into the underlying soil and forming ruts in the surface. The mats or runners may displace direct energy from the vehicle tires as the tires traverse the mats. The mats tend to be quite heavy and may require equipment such as skidders or loaders for transport and deployment. Frequently, however, these mats or runners may be unusable after 2-3 uses.

Accordingly, temporary roadway assemblies which are durable, capable of multiple uses and can be easily stored, transported and deployed on a ground surface to support and provide optimum traction to vehicles as the vehicles traverse the surface may be desirable for some applications.

SUMMARY

Illustrative embodiments of the disclosure are generally directed to temporary roadway assemblies for deployment on a ground surface to support and provide traction to vehicles as the vehicles traverse the surface. An illustrative embodiment of the temporary roadway assemblies may include a plurality of flexible, resilient, bendable, and rollable runner members. Each runner member may include a base panel having a base panel outer surface and a base panel inner surface opposite the base panel outer surface. A ground traction surface may be disposed at the base panel inner surface of the base panel. At least one ground traction element may be provided at the ground traction surface. The ground traction element may be configured to engage the ground surface and facilitate traction of each corresponding runner member with respect to the ground surface. A vehicle traction surface may be disposed at the base panel outer surface of the base panel. At least one vehicle traction element may be provided at the vehicle traction surface. The vehicle traction element may be configured to facilitate traction between vehicle wheels on the vehicles and each corresponding runner member. A plurality of flexible, elastic, or resilient runner member connectors may be configured to connect adjacent ones of the plurality of runner members.

Illustrative embodiments of the disclosure are further generally directed to methods of facilitating transport of a vehicle on a ground surface. An illustrative embodiment of the methods may include obtaining a temporary roadway assembly including a plurality of flexible, resilient, bendable, and rollable runner members; rolling the runner members of the temporary roadway assembly on a roadway assembly dispenser, transporting the roadway assembly dispenser to the ground surface; unrolling the plurality of runner members of the temporary roadway assembly from the roadway assembly dispenser onto the ground surface; and transporting the vehicle on the plurality of runner members of the temporary roadway assembly.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
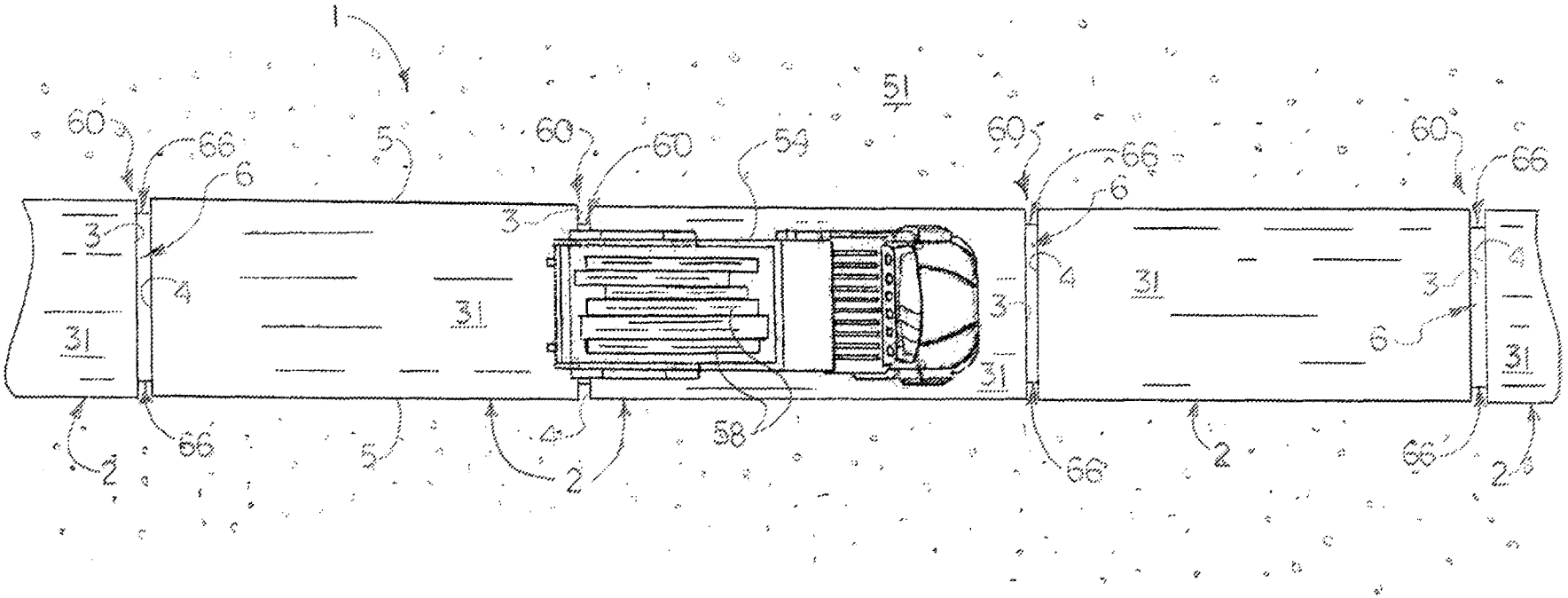
FIG. 1 is atop view, partially in section, of an illustrative embodiment of the temporary roadway assemblies, deployed on a ground surface with a loaded log truck traversing the connected runner members of the assembly in typical application of the assemblies.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower". "left". "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 1-12 of the drawings, an illustrative embodiment of the temporary roadway assemblies, hereinafter assembly, is generally indicated by reference numeral 1. As illustrated in FIGS. 1-4, in typical application, which will be hereinafter described, the assembly 1 may be deployed on a ground surface 51 which overlies soil 50. The soil 50 may include soft soil such as loose or moist dirt or mud. The deployed assembly 1 may provide optimum support and traction to log trucks and/or other vehicles 54 as the vehicles 54 traverse the ground surface 51 typically from a paved roadway or other vehicle origin (not illustrated) to a mill, hydrocarbon well or other vehicle destination (not illustrated) at which the vehicle 54 is to deliver cut logs 58, well fluids or other items, for example and without limitation, at the destination.

Figure 3:
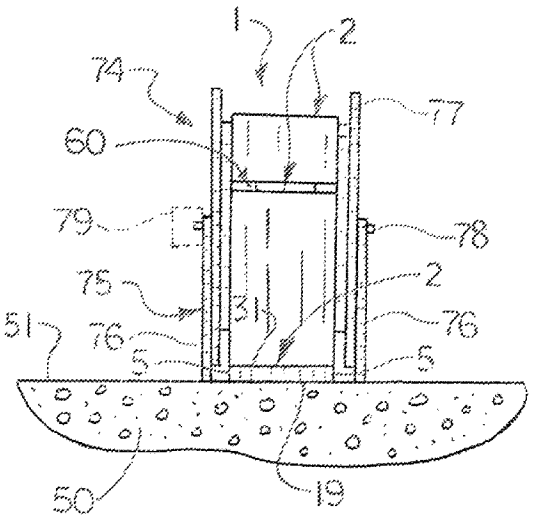
FIG. 3 is a front view of a typical roadway assembly dispenser, deployed on a ground surface with an illustrative embodiment of the temporary roadway assemblies wound on the dispenser, more particularly illustrating typical unrolling of the assembly from the dispenser onto the ground surface in typical application of the assemblies.
Figure 4:
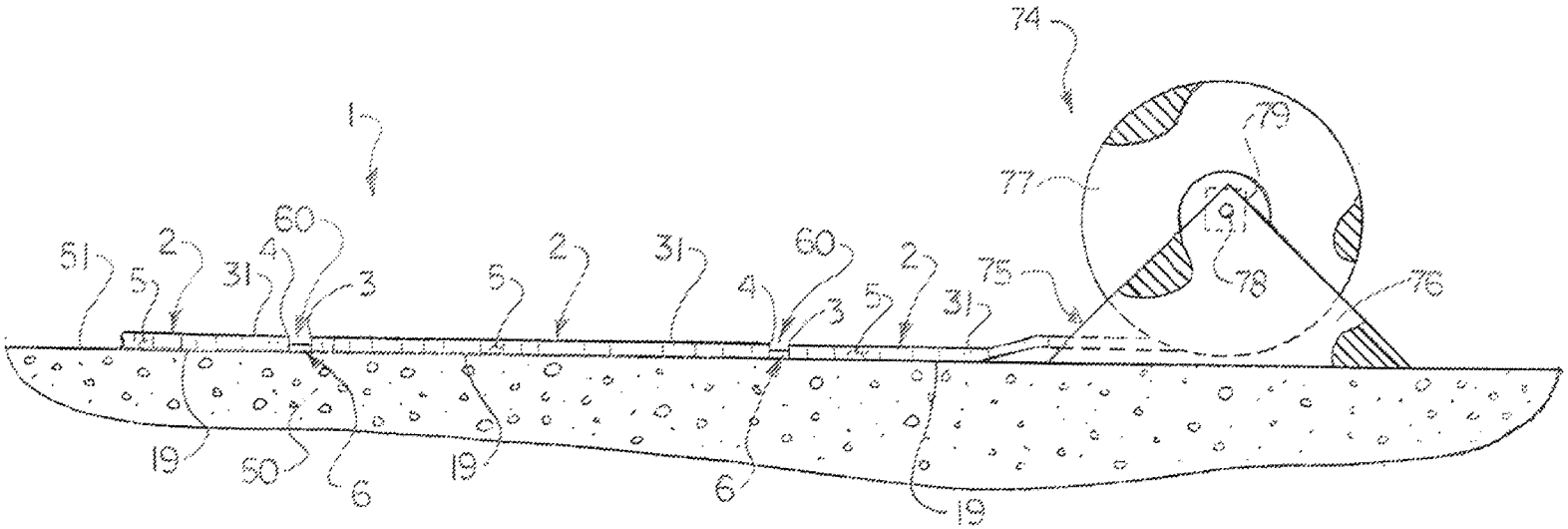
FIG. 4 is a side view of the roadway assembly dispenser and the partially unwound and deployed temporary roadway assembly illustrated in FIG. 3.

As illustrated in FIGS. 3 and 4, in some embodiments, the assembly 1 may include a roadway assembly dispenser 74. The assembly 1 may be stowable on or in and selectively dispensable from the roadway assembly dispenser 74. Accordingly, the roadway assembly dispenser 74, with the stowed assembly 1, may be transported to the ground surface 51 near or in the vicinity of the destination at which the vehicle 54 is to unload the cut logs 58. The assembly 1 may be unrolled or extended from the roadway assembly dispenser 74 onto the ground surface 51. As the vehicles 54 traverse the assembly 1 from the vehicle origin in transit to the vehicle destination, the assembly 1 may prevent the vehicles 54 from forming ruts in the ground surface 51 and sinking or becoming bogged in the underlying soil 50 while optimizing traction of the vehicle wheels 55 of each vehicle 54.

Figure 5:
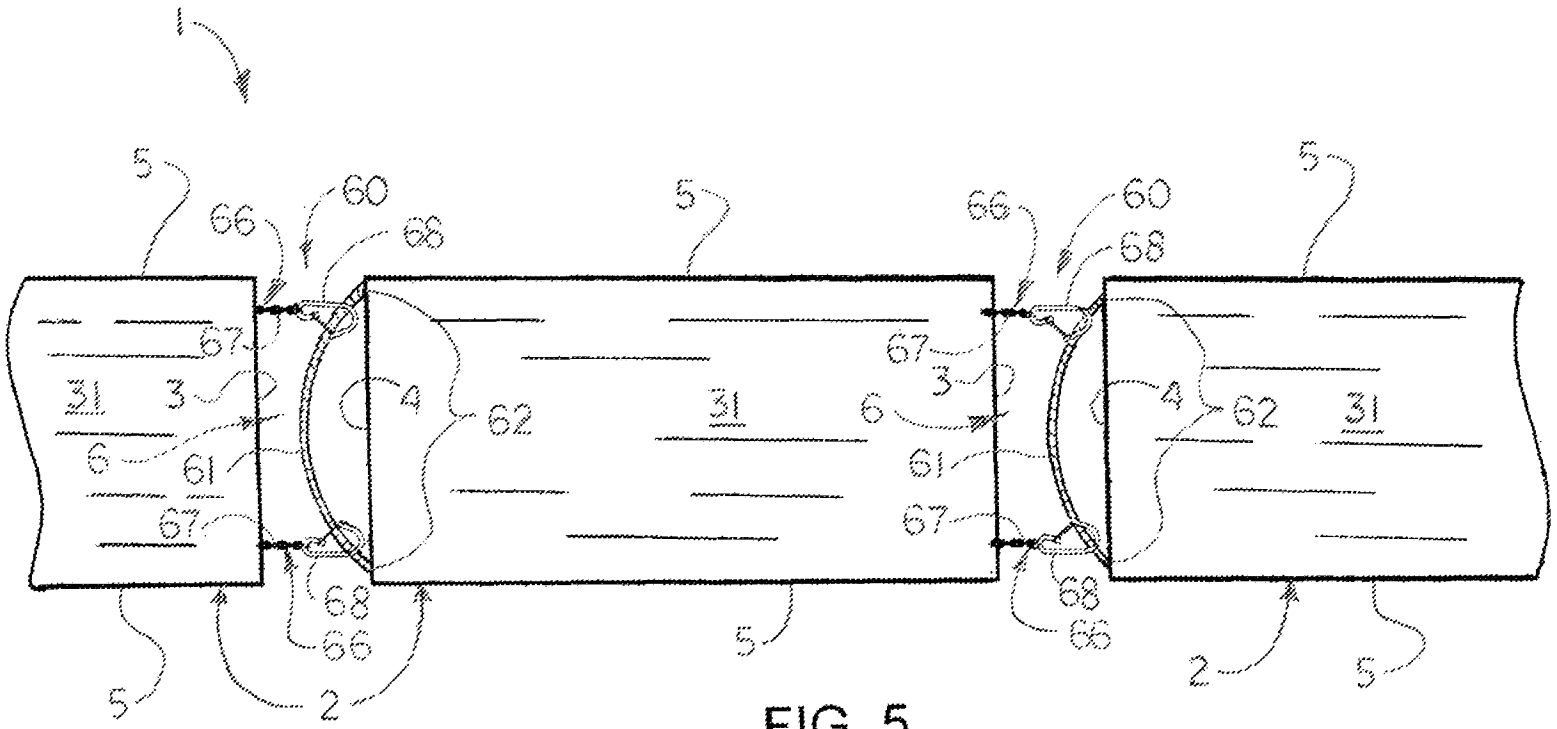
FIG. 5 is an enlarged top view, partially in section, of the illustrative temporary roadway assembly, more particularly illustrating typical runner member connector resiliently connecting the adjacent runner members to each other in the assembly.
Figure 6:
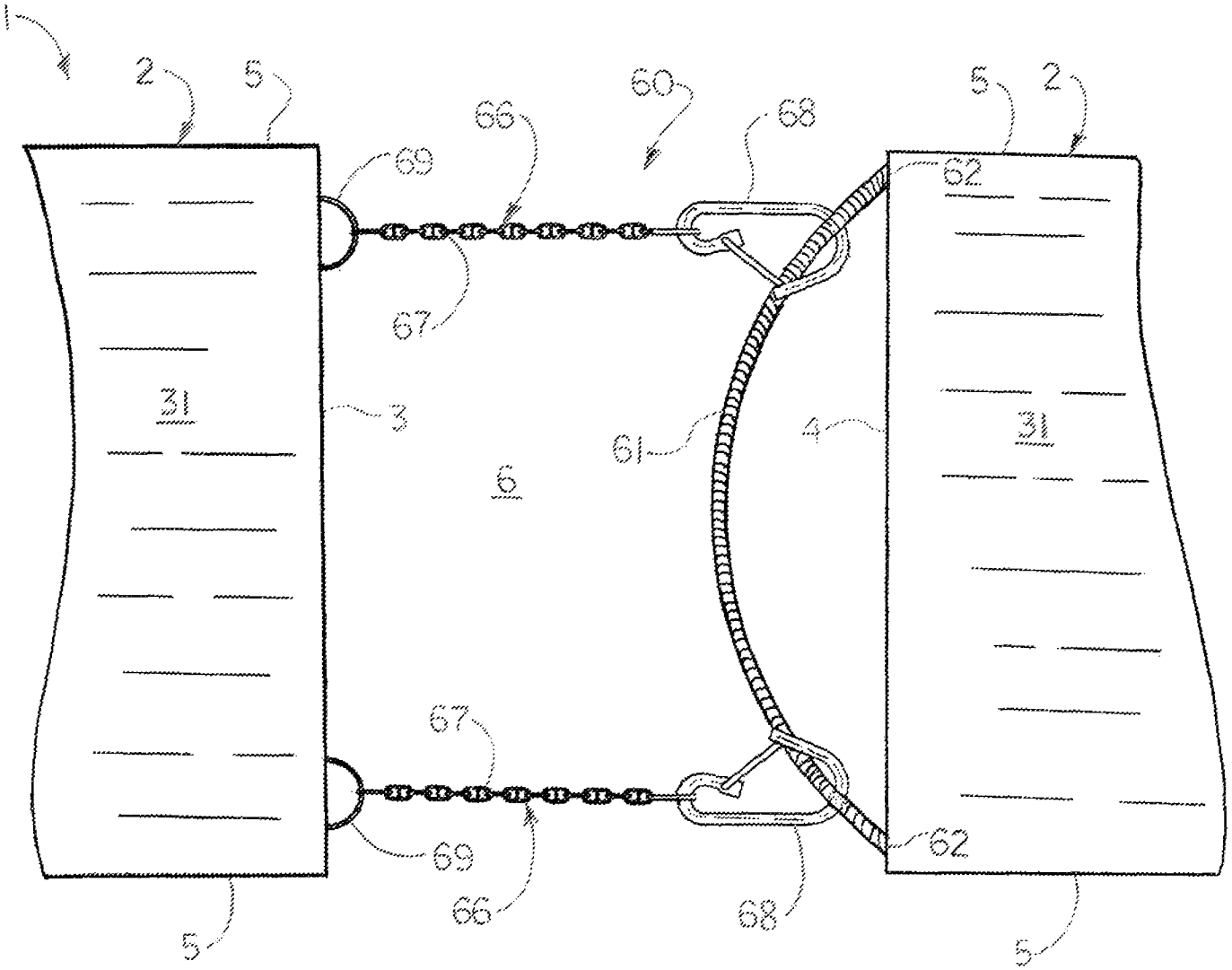
FIG. 6 is an enlarged top sectional view of the runner member connector connecting the adjacent runner members (shown partially in section) in the assembly.

As illustrated in FIGS. 5 and 6, the assembly 1 may include multiple, interconnected, rollable runner members 2. Each runner member 2 may be elongated and rectangular with a first runner member end 3 and a second runner member end 4 opposite the first runner member end 3. A pair of elongated, parallel, spaced-apart runner member side edges 5 may extend from the first runner member end 3 to the second runner member end 4. Each runner member 2 may be rollable from the first runner member end 3 to the second runner member end 4, typically for purposes which will be hereinafter described.

Each runner member 2 may have a lower, ground traction surface 19 and an upper, vehicle traction surface 31. In deployment of the assembly 1 on the ground surface 51, which will be hereinafter described, the ground traction surface 19 may rest on the ground surface 51, whereas the vehicle traction surface 31 may face upwardly away from the ground surface 51. The ground traction surface 19 may impart optimum traction of each runner member 2 on the ground surface 51. The vehicle traction surface 31 may provide a suitable surface to facilitate support and traversal of the vehicles 54 along the assembly 1. The vehicle traction surface 31 may provide a support surface for the vehicle wheels 55 of the vehicles 54 to prevent the formation of ruts in the ground surface 51 while providing optimum traction between the vehicle wheels 55 and the runner members 2.

At least one flexible, elastic, or resilient runner member connector 60 may connect adjacent ones of the runner members 2 in the assembly 1. Each runner member connector 60 may resiliently connect the first runner member end 3 of each runner member 2 to the second runner member end 4 of each corresponding adjacent runner member 2 to enable rolling or bending of the adjacent runner members 2 with respect to each other. A runner member gap 6 may separate the first runner member end 3 of each runner member 2 from the interfacing second runner member end 4 of each adjacent runner member 2. Accordingly, the runner member connector 60 may span the runner member gap 6.

Each runner member connector 60 may have any design or construction which is suitable for resiliently connecting the adjacent runner members 2 to each other in the assembly 1. For example and without limitation, as illustrated in FIGS. 5 and 6, in some embodiments, each runner member connector 60 may include at least one connector tether 66. The connector tether 66 of each runner member connector 60 may include a tether chain 67 which extends from a first one of the adjacent runner members 2. In some embodiments, a tether ring 69 may attach each tether chain 67 to the corresponding runner member 2. A connector cable 61 may extend from a second one of the adjacent runner members 2. The connector tether 66 may engage the connector cable 61 such as through a tether clip 68, for example and without limitation. The tether chain 67 of each connector tether 66 may be attached to the corresponding runner member 2 via a bolt and/or other suitable fastener (not illustrated). In like manner, the connector cable 61 may have connector cable ends 62 (FIG. 6) which may be attached to the corresponding runner member 2 via any suitable fastening method or technique. In some embodiments, the tether clip 68 may facilitate releasable attachment of the tether chain 67 of the connector tether 66 to the connector cable 61. Alternatively, in some embodiments, the tether clip 68 may be attachable to an eye bolt (not illustrated) which extends from the second member end 4 of the corresponding runner member 2.

The roadway assembly dispenser 74 may have any design or construction which is suitable for the purpose of stowing the runner members 2 for storage and transport. For example and without limitation, in some embodiments, the roadway assembly dispenser 74 may be suitably configured to maintain the assembly 1 in a wound configuration and facilitate unwinding or payment of the assembly 1 onto the ground surface 51. For example and without limitation, as illustrated in FIGS. 3 and 4, in some embodiments, the roadway assembly dispenser 74 may have a dispenser base 75. A dispenser spool 77 may be rotatably supported by the dispenser base 75. The dispenser spool 77 may be suitably sized and configured to support and maintain the assembly 1 in a wound configuration thereon. A spool actuator 79 (illustrated in phantom) may drivingly engage the dispenser spool 77 for rotation on the dispenser base 75. The spool actuator 79 may include a motor, crank and/or any other suitable drive mechanism which is suitable for rotating the dispenser spool 77.

In some embodiments, the dispenser base 75 may have a pair of spaced-apart dispenser base flanges 76. A spool axle 78 may extend from the dispenser spool 77. The spool axle 78 may engage the dispenser base flanges 76 to rotatably mount the dispenser spool 77 between the dispenser base flanges 76. The spool actuator 79 may drivingly engage the spool axle 78 for rotation according to the knowledge of those skilled in the art.

Figure 9:
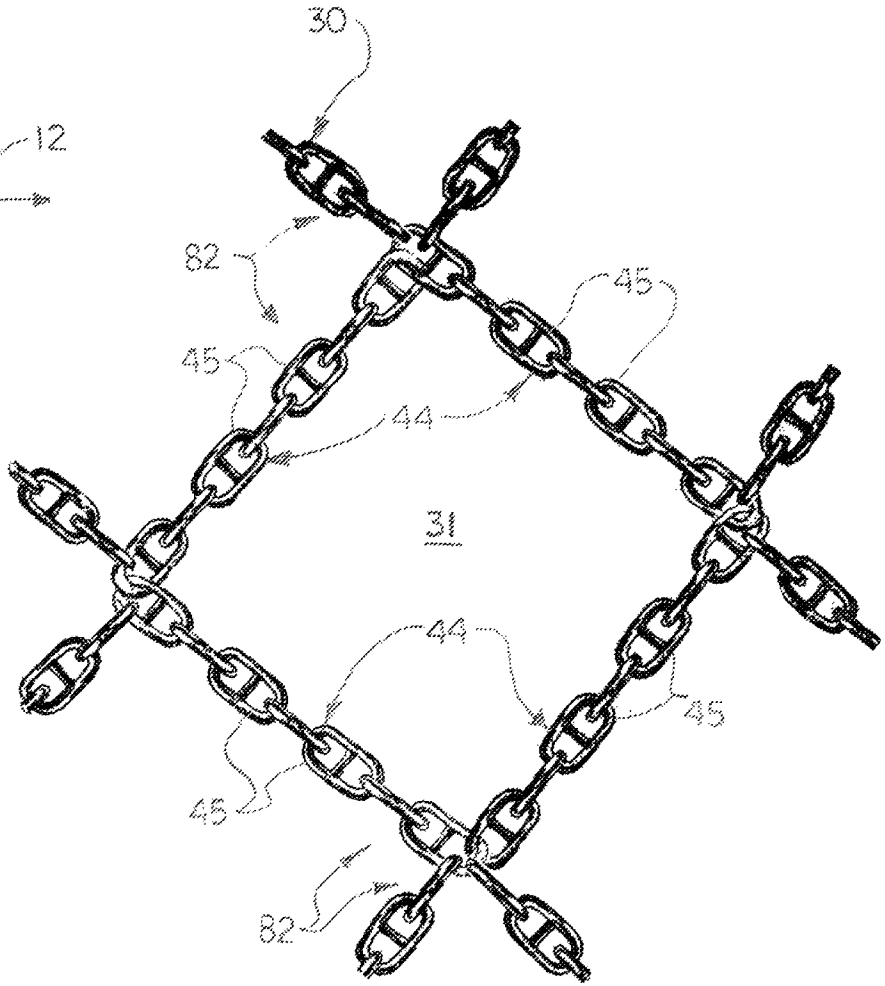
FIG. 9 is an enlarged sectional view, taken along section line 9 in FIG. 8, of a typical vehicle traction panel of the runner member, more particularly illustrating a network of traction chains in the vehicle traction panel.
Figure 10:
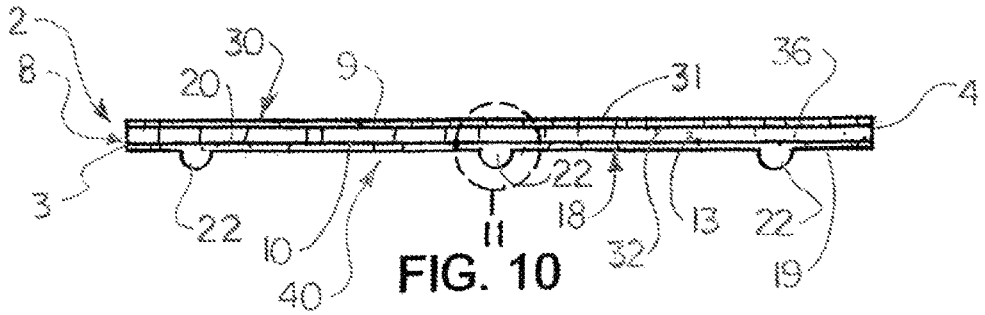
FIG. 10 is a side view of the runner member illustrated in FIGS. 7 and 8.
Figure 11:
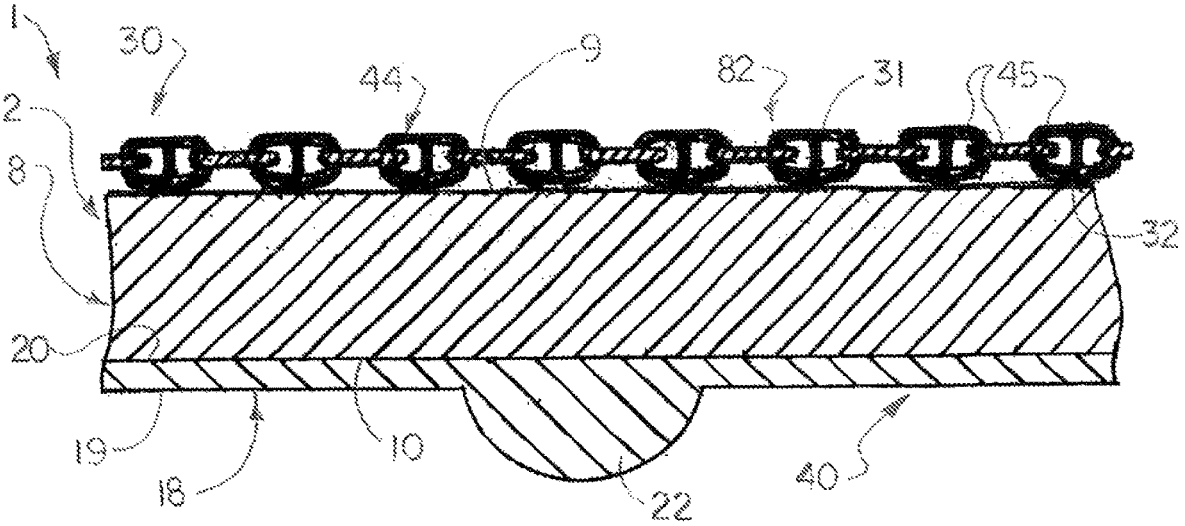
FIG. 11 is an enlarged sectional view, taken along section line 11 in FIG. 10, of the runner member.

Referring next to FIGS. 7-11 of the drawings, in some embodiments, each runner member 2 of the assembly 1 may include a base panel 8, as illustrated in FIGS. 10 and 11. The base panel 8 may have a base panel outer surface 9 and a base panel inner surface 10. The ground traction surface 19 and the vehicle traction surface 31 may be disposed at the respective opposite base panel inner surface 10 and base panel outer surface 9 of the base panel 8. In some embodiments, the ground traction surface 19 of each runner member 2 may include a ground traction panel 18 provided on the base panel inner surface 10 of base panel 8, as illustrated. The vehicle traction surface 31 may include a vehicle traction panel 30 provided on the base panel outer surface 9 of the base panel 8. Accordingly, the base panel 8 may be sandwiched between the ground traction panel 18 and the vehicle traction panel 30.

Each of the base panel 8, the ground traction panel 18 and the vehicle traction panel 30 of each runner member 2 may be rollable. Accordingly, each runner member 2 may be rollable from the first runner member end 3 to the second runner member end 4 to facilitate winding of the assembly 1 on the dispenser spool 77 of the roadway assembly dispenser 74. The base panel 8, the ground traction panel 18, and the vehicle traction panel 30 may each be fabricated of a flexible, resilient, bendable, and rollable material. For example and without limitation, in some embodiments, the base panel 8 and/or the ground traction panel 18 may include rubber, composite material, flexible or resilient plastic, or combinations thereof. The vehicle traction panel 30 may be constructed typically as will be hereinafter described.

As further illustrated in FIGS. 10 and 11, the base panel 8 may have the base panel outer surface 9 and the base panel inner surface 10 opposite the base panel outer surface 9. The ground traction panel 18 may have the ground traction surface 19 and a ground traction panel inner surface 20 which is opposite the ground traction surface 19. The ground traction panel inner surface 20 of the ground traction panel 18 may be attached to the base panel inner surface 10 of the base panel 8. Attachment may be accomplished via mechanical fasteners (not illustrated), adhesives, stitching, and/or other suitable attachment technique known by those skilled in the art. For example and without limitation, in some embodiments, bolts may extend through respective sets of registering bolt openings in the base panel 8, the ground traction panel 18 and the vehicle traction panel 30. The bolts, typically with securing nuts threaded thereon, may secure the base panel 8, the ground traction panel 18 and the vehicle traction panel 30 together in a single assembly.

Figure 7:
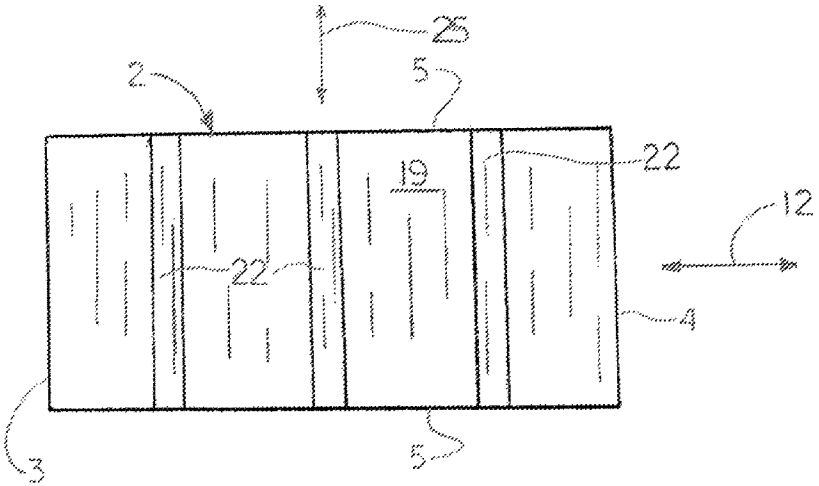
FIG. 7 is a bottom view of a typical runner member of an illustrative embodiment of the temporary roadway assemblies.
Figure 12:
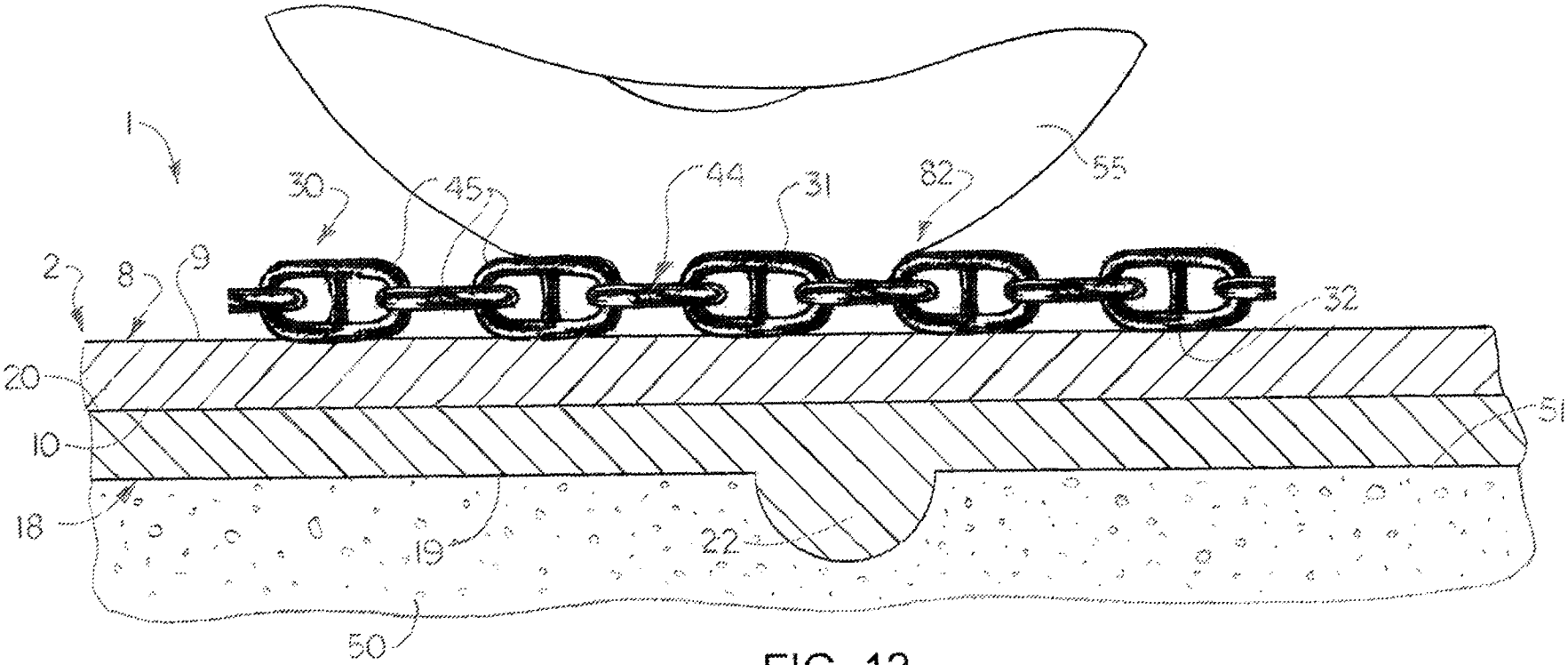
FIG. 12 is an enlarged sectional view of the runner member, also taken along section line 1I in FIG. 10, with the runner member deployed on a ground surface in the temporary roadway assembly and a vehicle wheel of a vehicle traversing the vehicle traction panel of the runner member in typical application of the assembly.
Figure 15:
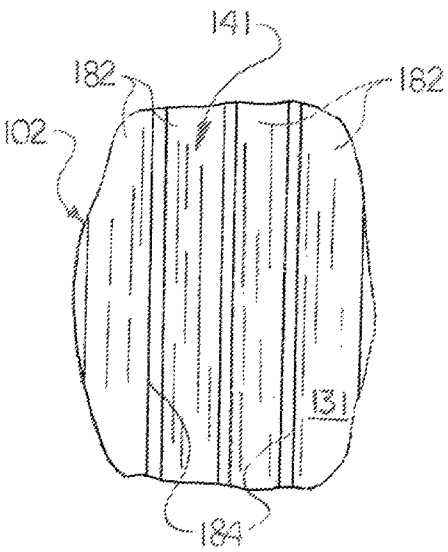
FIG. 15 is an enlarged sectional view, taken along section line 15 in FIG. 14, of the runner member.
Figure 13:
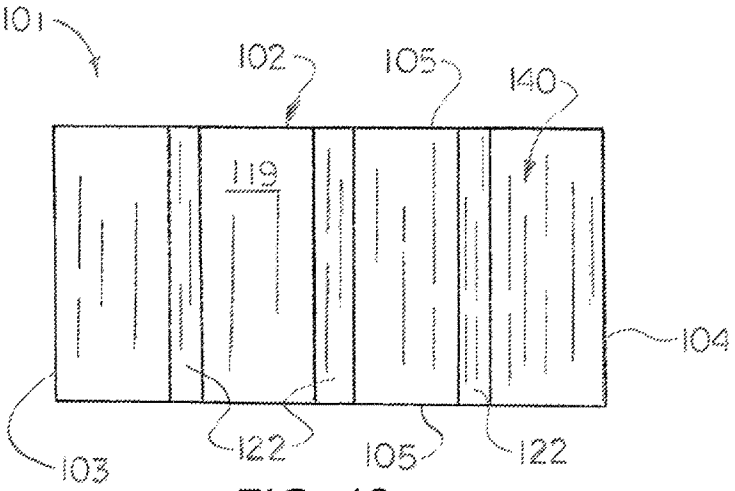
FIG. 13 is a bottom view of an alternative runner member according to an illustrative embodiment of the temporary roadway assemblies.
Figure 14:
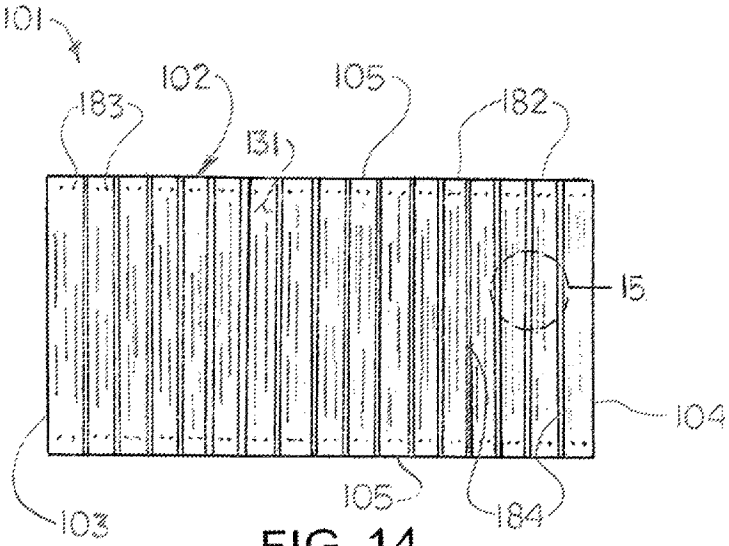
FIG. 14 is a top view of the runner member illustrated in FIG. 13.
Figure 16:
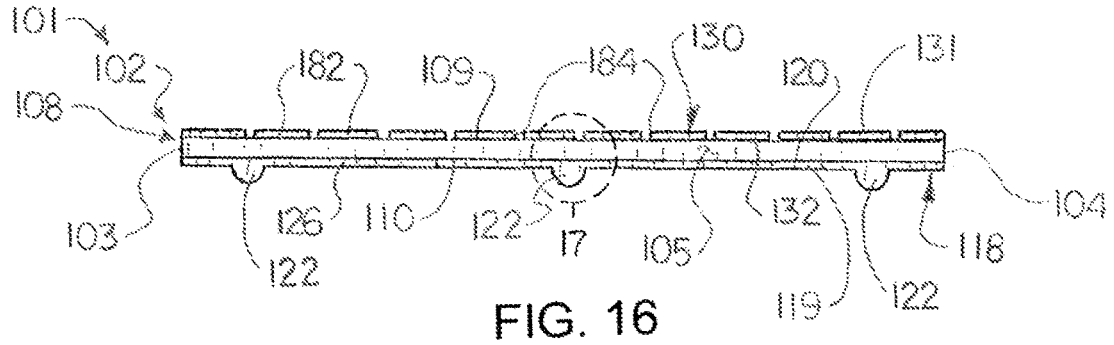
FIG. 16 is a side view of the runner member illustrated in FIGS. 13 and 14.

In some embodiments, the ground traction surface 19 of each runner member 2 may include at least one ground traction element 22. As illustrated in FIG. 7, in some embodiments, each ground traction element 22 may be elongated and oriented perpendicular to a direction of travel 12 of each vehicle 54 along the runner member 2, typically having a ground traction element axis 25 which extends parallel to the first runner member end 3 and the second runner member end 4 and perpendicular to and between the runner member side edges 5. As illustrated in FIG. 12, in the deployed assembly 1, each ground traction element 22 may be configured to engage the ground surface 51 and protrude into the underlying soil 50 to facilitate traction of the ground traction panel 18 with respect to the ground surface 51 and resist longitudinal movement of the runner member 2 along the direction of travel 12 of the vehicles 54.

Each ground traction element 22 on the ground traction surface 19 may have any design or structure which protrudes from the plane of the ground traction panel 18. For example and without limitation, as illustrated in FIGS. 7 and 10-12, in some embodiments, each ground traction element 22 may include at least one bump or protrusion of the ground traction panel 18. The bump or protrusion may be molded and/or otherwise formed in one piece with the ground traction panel 18, as illustrated, according to the knowledge of those skilled in the art. Alternatively, the ground traction element or elements 22 may be fabricated separately from the ground traction panel 18 and attached to the ground traction surface 19 of the ground traction panel 18 using adhesive, stitching, bolts, and/or other mechanical fasteners (not illustrated) or fastening techniques known by those skilled in the art. For example and without limitation, in some embodiments, the bolts which secure the base panel 8, the ground traction panel 18 and the vehicle traction panel 30 may further attach each ground traction element 22 to the ground traction surface 19. In some embodiments, each ground traction element 22 may include at least one chain, slat, plate, bar, tube, and/or other structural member which may be attached to the ground traction surface 19 according to the knowledge of those skilled in the art. Each ground traction element 22 may include rubber, plastic, composite material, metal, wood, concrete, polycarbonate and/or other suitable durable material or materials known by those skilled in the art.

In some embodiments, the ground traction element or elements 22 may protrude directly from the base panel inner surface 10 of the base panel 8. The ground traction element or elements 22 may be molded and/or otherwise formed in one piece with the base panel 8 according to the knowledge of those skilled in the art. Alternatively, the ground traction element or elements 22 may be fabricated separately from the base panel 8 and attached to the base panel inner surface 10 of the base panel 8 using adhesive, stitching, bolts, and/or other mechanical fasteners or techniques known by those skilled in the art.

In some embodiments, the vehicle traction surface 31 of each runner member 2 may include at least one vehicle traction element 82. As illustrated in FIG. 12, in the deployed assembly 1, each vehicle traction element 82 may face upwardly to facilitate traction between the vehicle wheels 55 of the vehicles 54 and the runner member 2.

As further illustrated in FIGS. 10-12, the vehicle traction panel 30 of each runner member 2 may have the vehicle traction surface 31 and a vehicle traction panel inner surface 32 opposite the vehicle traction surface 31. The vehicle traction panel inner surface 32 may be attached to the base panel outer surface 9 of the base panel 8 via mechanical fasteners (not illustrated), adhesives and/or other suitable attachment technique.

Figure 8:
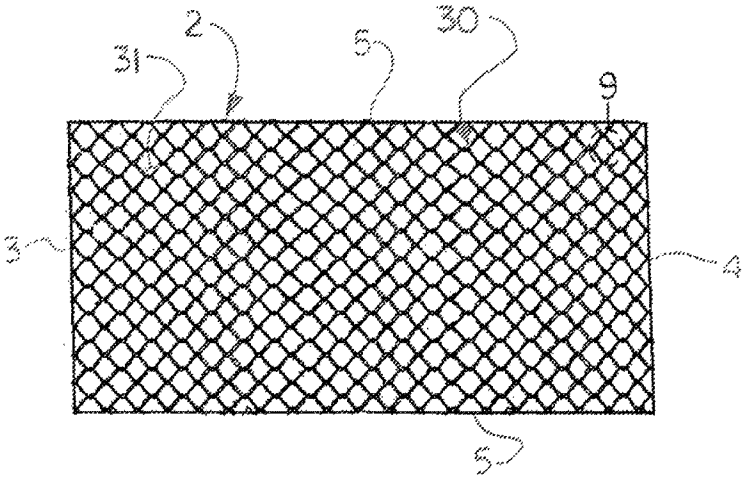
FIG. 8 is a top view of the runner member illustrated in FIG. 7.

In some embodiments, the vehicle traction panel 30 may have multiple vehicle traction elements 82 at the vehicle traction surface 31. Each vehicle traction element 82 may have any design which protrudes from the plane of the vehicle traction panel 30. For example and without limitation, as illustrated in FIGS. 8, 9 and 11, in some embodiments, the vehicle traction elements 82 may include multiple traction chains 44. As illustrated in FIGS. 8 and 9, the traction chains 44 may be disposed in a crisscrossing orientation to each other. Accordingly, the traction chains 44 may form a traction chain lattice or meshwork in the vehicle traction panel 30. Each traction chain 44 may include multiple, linked traction chain links 45. The traction chain links 45 in each traction chain 44 may include periodic connecting chain links 46 which connect to the connecting chain links 46 in the other traction chains 44 to form the crisscrossing meshwork of the traction chains 44. As illustrated in FIG. 8, the traction chains 44 of the vehicle traction panel 30 may cover an entire area of the base panel outer surface 9 on the base panel 8 from the first runner member end 3 to the second runner member end 4 and between the runner member side edges 5 of each runner member 2. As illustrated in FIG. 11, the linked traction chain links 45 of the traction chains 44 may be disposed in a taut configuration against the base panel outer surface 9 of the base panel 8.

Referring again to FIGS. 1-12 of the drawings, in typical application, the assembly 1 may be deployed on the ground surface 51, extending typically from a paved roadway or other vehicle origin (not illustrated) to a mill at which logs 58 transported on the vehicles 54 will be cut into lumber. Alternatively, the assembly 1 may be deployed on a ground surface 51 between a paved roadway and a hydrocarbon well, such as in applications in which the vehicles 54 carry well fluids or well drilling or production items or the like, or other vehicle destination. Accordingly, the distance from the vehicle origin to the vehicle destination may be determined or estimated. The assembly 1 may be fabricated by attaching a selected number of the runner members 2 to each other, typically by engagement of the runner member connectors 60 as was heretofore described. The number of runner members 2 which are attached to each other to form the assembly 1 may depend on the determined distance over which the vehicles 54 will traverse typically from the vehicle origin to the vehicle destination. The assembly 1 having the selected number of runner members 2 may then be deployed or wound on the dispenser spool 77 of the roadway assembly dispenser 74, typically by actuation of the spool actuator 79. The roadway assembly dispenser 74, with the assembly 1 wound thereon, may be transported to the ground surface 51.

At the ground surface 51, the dispenser base flanges 76 of the dispenser base 75 may be placed on the ground surface 51. The assembly 1 may be unrolled or extended from the dispenser spool 77 of the roadway assembly dispenser 74, typically by actuation of the spool actuator 79, and laid onto the ground surface 51, typically extending from the paved roadway to the mill, hydrocarbon well or other destination. As illustrated in FIG. 12, as the runner members 2 are sequentially deployed onto the ground surface 51, the ground traction surface 19 of each runner member 2 may rest on the ground surface 51. The ground traction elements 22 on the ground traction surface 19 may extend into the ground surface 51 to enhance the traction between each runner member 2 and the ground surface 51.

Figure 2:
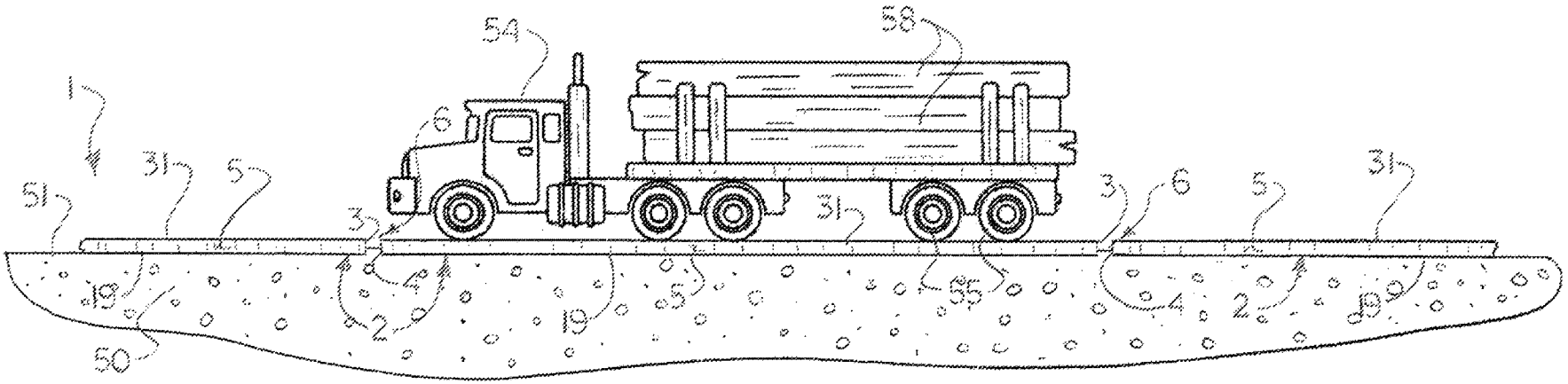
FIG. 2 is a side view, partially in section, of the illustrative temporary roadway assembly illustrated in FIG. 1, deployed on the ground surface with the log truck traversing the runner members of the assembly.

As illustrated in FIGS. 1 and 2, each vehicle 54 may traverse the runner members 2 as the vehicle travels from the vehicle origin to the vehicle destination. As illustrated in FIG. 12, the runner members 2 may provide a solid support for the vehicle wheels 55 of the vehicle 54 as the vehicle 54 traverses the assembly 1. Additionally, the vehicle traction elements 82 on the vehicle traction surface 31 of the vehicle traction panel 30 may provide optimum traction to the vehicle wheels 55 as the vehicles 54 traverse the assembly 1. The assembly 1 may prevent the vehicle wheels 55 from forming ruts in the ground surface 51 and sinking or becoming bogged in the underlying soil 50. The assembly 1 may in like manner provide support to the vehicles 54 as the vehicles 54 travel from the vehicle destination back to the vehicle origin.

After use, the assembly 1 may be rewound on the dispenser spool 77 of the roadway assembly dispenser 74. The roadway assembly dispenser 74 may be transported to another location for use or back to a suitable storage facility.

Referring next to FIGS. 13-17 of the drawings, an alternative illustrative embodiment of the temporary roadway assemblies is generally indicated by reference numeral 101. In the assembly 101, elements which are analogous to the respective elements of the assembly 1 that was heretofore described with respect to FIGS. 1-12 are designated by the same respective numerals in the 101-199 series in FIGS. 13-17. Accordingly, to the extent applicable, the same description which was set forth above with respect to the assembly 1 is incorporated by reference herein in its entirety with respect to the assembly 101.

The vehicle traction elements 182 on the vehicle traction surface 131 of each runner member 102 of the assembly 101 may include multiple, parallel, spaced-apart boards or slats. Vehicle traction gaps 184 may extend between the adjacent vehicle traction elements 182. Each vehicle traction element 182 may include rubber, plastic, composite material, metal, wood, concrete, polycarbonate and/or other suitable durable material or materials known by those skilled in the art. The vehicle traction elements 182 with intervening vehicle traction gaps 184 may collectively form the vehicle traction panel 130 of each runner member 102.

Figure 17:
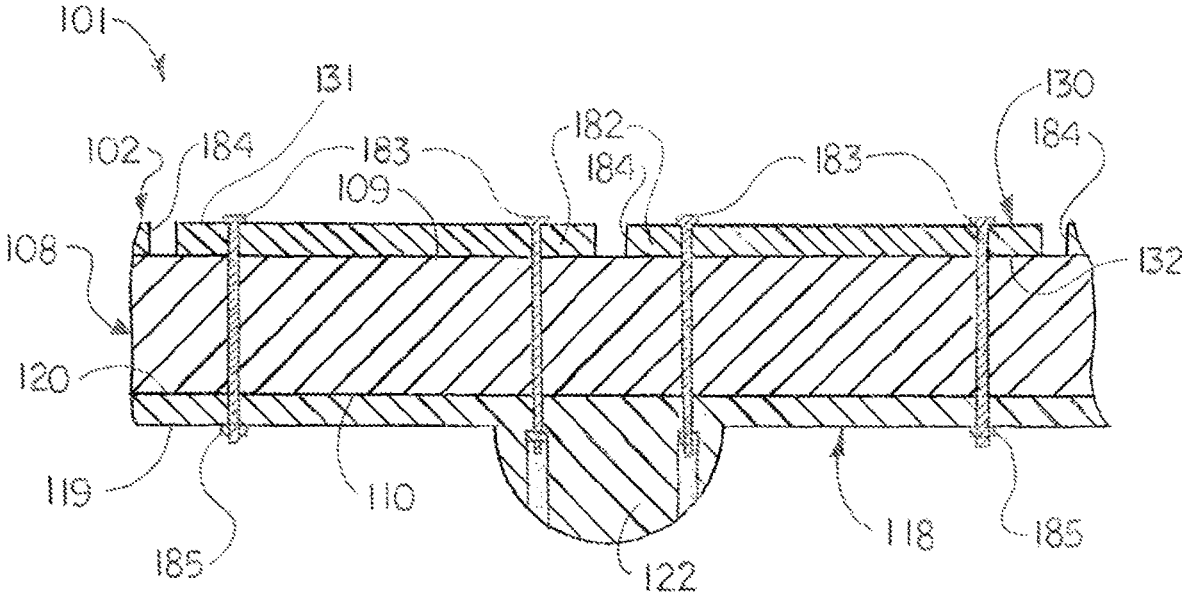
FIG. 17 is an enlarged sectional view, taken along section line 17 in FIG. 16, of the runner member.
Figure 20:
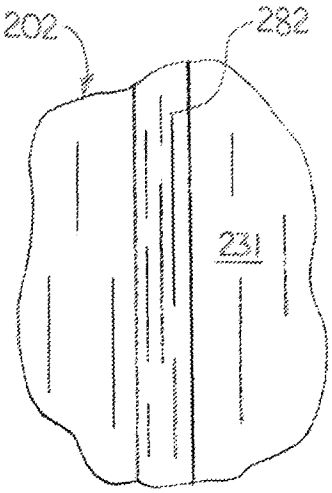
FIG. 20 is an enlarged sectional view, taken along section line 20 in FIG. 19, of the runner member.
Figure 18:
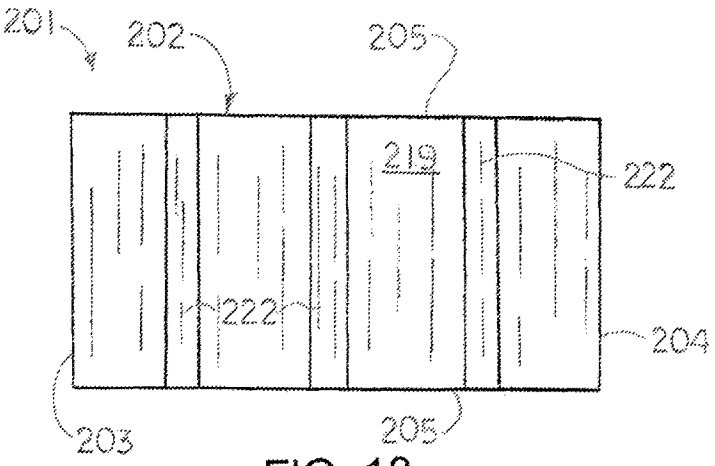
FIG. 18 is a bottom view of another alternative runner member according to an illustrative embodiment of the temporary roadway assemblies.
Figure 19:
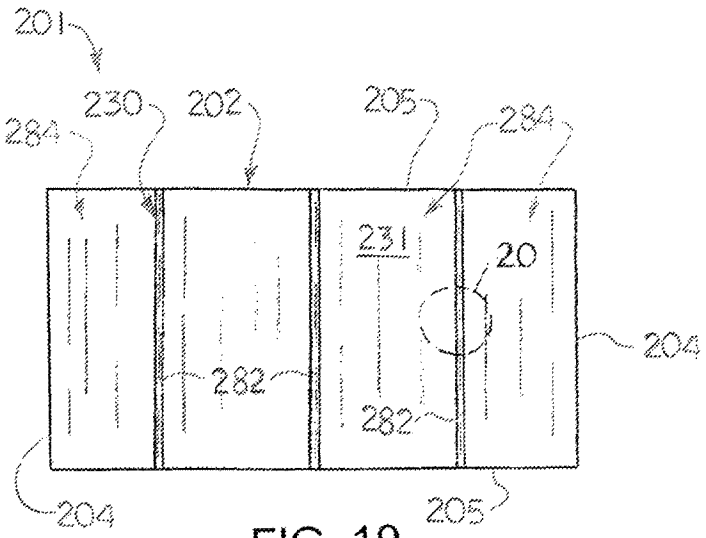
FIG. 19 is a top view of the runner member illustrated in FIG. 18.
Figure 21:
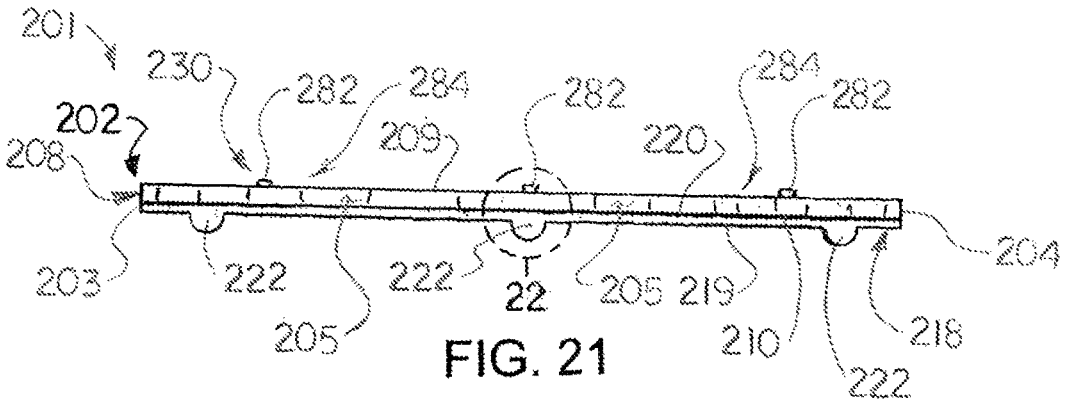
FIG. 21 is a side view of the runner member illustrated in FIGS. 18 and 19.
Figure 22:
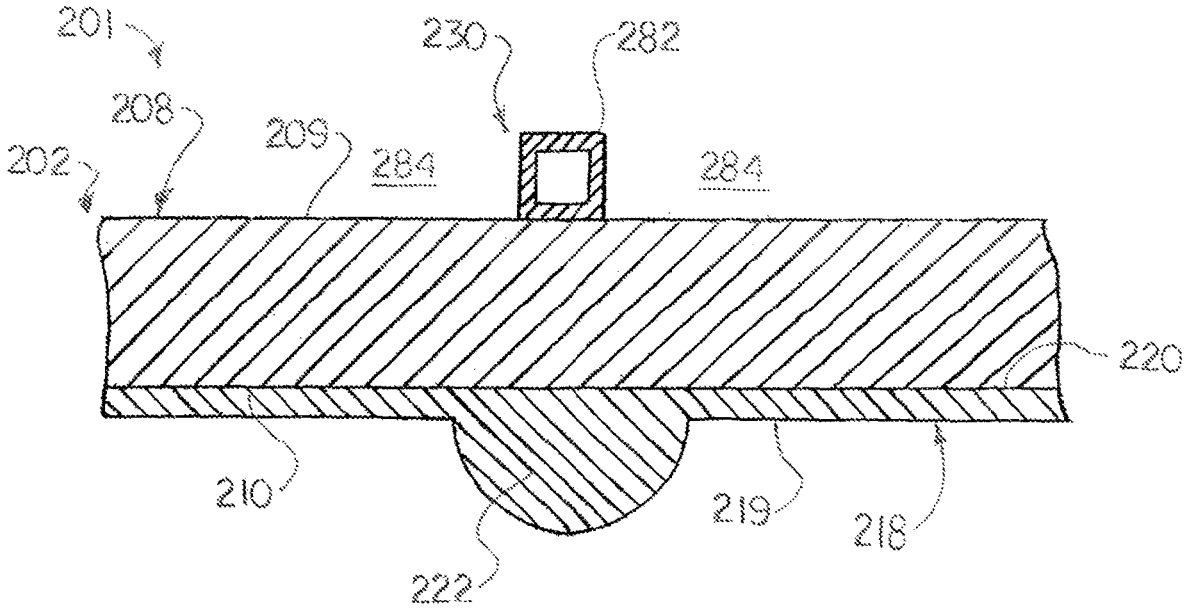
FIG. 22 is an enlarged sectional view, taken along section line 22 in FIG. 21, of the runner member.
Figure 25:
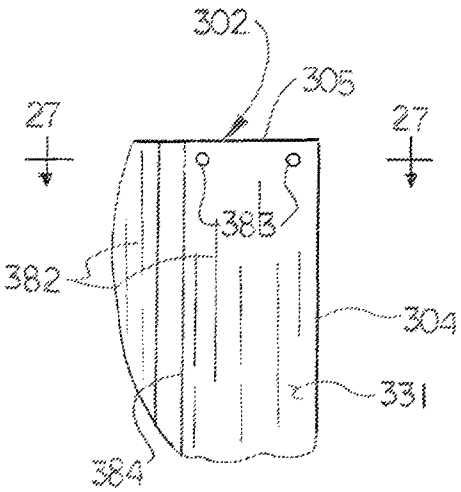
FIG. 25 is an enlarged sectional view, taken along section line 25 in FIG. 24, of the runner member.

In some embodiments, traction element fasteners 183 may attach each vehicle traction element 182 to the base panel 108. As illustrated in FIG. 17, each traction element fastener 183 may include a bolt which extends through registering bolt openings in the vehicle traction panel 130, the base panel 108 and the ground traction panel 118, respectively. A securing nut 185 may be threaded on each bolt.

Application of the assembly 101 may be as was heretofore described with respect to the assembly 1. As the vehicles 54 (FIGS. 1 and 2) traverse the assembly 101, the vehicle traction elements 182 impart traction between the vehicle wheels 55 and the runner member 102.

Referring next to FIGS. 18-22 of the drawings, an alternative illustrative embodiment of the temporary roadway assemblies is generally indicated by reference numeral 201. In the assembly 201, elements which are analogous to the respective elements of the assembly 1 that was heretofore described with respect to FIGS. 1-12 are designated by the same respective numerals in the 101-199 series in FIGS. 13-17. Accordingly, to the extent applicable, the same description which was set forth above with respect to the assembly 1 is incorporated by reference herein in its entirety with respect to the assembly 201.

The vehicle traction elements 282 on the vehicle traction surface 231 of each runner member 202 of the assembly 201 may include multiple, parallel, spaced-apart tubing elements. For example and without limitation, in some embodiments, the tubing element of each vehicle traction element 282 may include square tubing, as illustrated. Vehicle traction gaps 284 may extend between the adjacent vehicle traction elements 282. Each vehicle traction element 282 may include rubber, plastic, composite material, metal, wood, concrete, polycarbonate and/or other suitable durable material or materials known by those skilled in the art. The vehicle traction elements 282 with intervening vehicle traction gaps 284 may collectively form the vehicle traction panel 230 of each runner member 202. In some embodiments, traction element fasteners (not illustrated) may attach each vehicle traction element 282 to the base panel 208, typically as was heretofore described with respect to the traction element fasteners 183 in FIG. 17.

Application of the assembly 201 may be as was heretofore described with respect to the assembly 1. As the vehicles 54 (FIGS. 1 and 2) traverse the assembly 201, the vehicle traction elements 282 impart traction between the vehicle wheels 55 and the runner member 202.

Referring next to FIGS. 23-27 of the drawings, another alternative illustrative embodiment of the temporary roadway assemblies is generally indicated by reference numeral 301. In the assembly 301, elements which are analogous to the respective elements of the assembly 1 that was heretofore described with respect to FIGS. 1-12 are designated by the same respective numerals in the 301-399 series in FIGS. 23-27. Accordingly, to the extent applicable, the same description which was set forth above with respect to the assembly 1 is incorporated by reference herein in its entirety with respect to the assembly 301.

Figure 23:
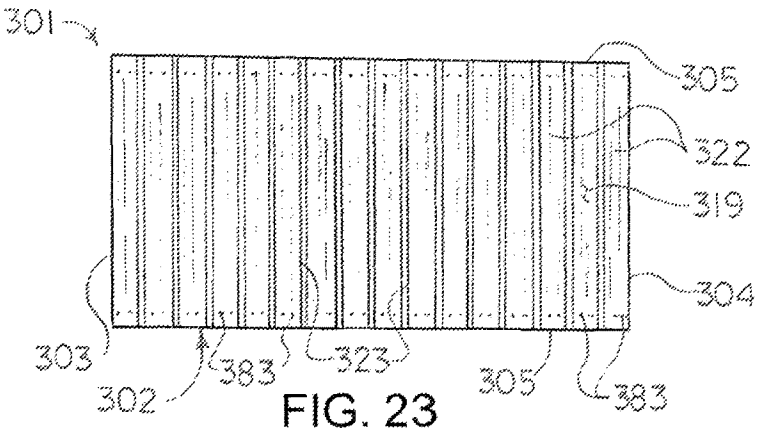
FIG. 23 is a bottom view of still another alternative runner member according to an illustrative embodiment of the temporary roadway assemblies.
Figure 24:
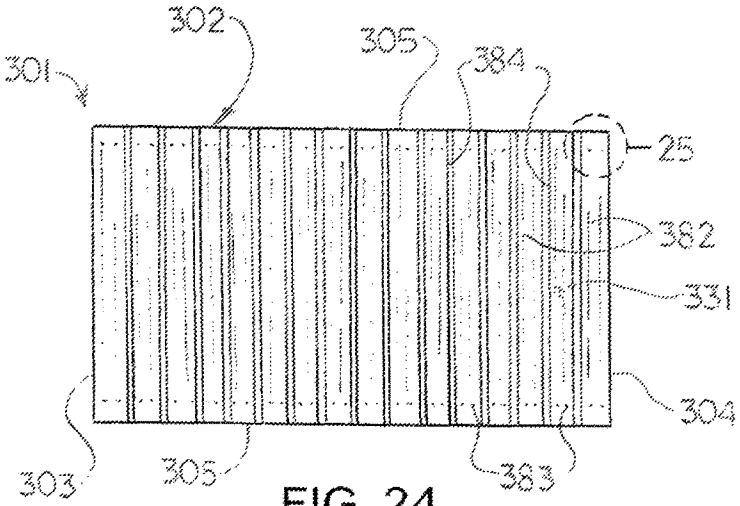
FIG. 24 is a top view of the runner member illustrated in FIG. 23.
Figure 26:
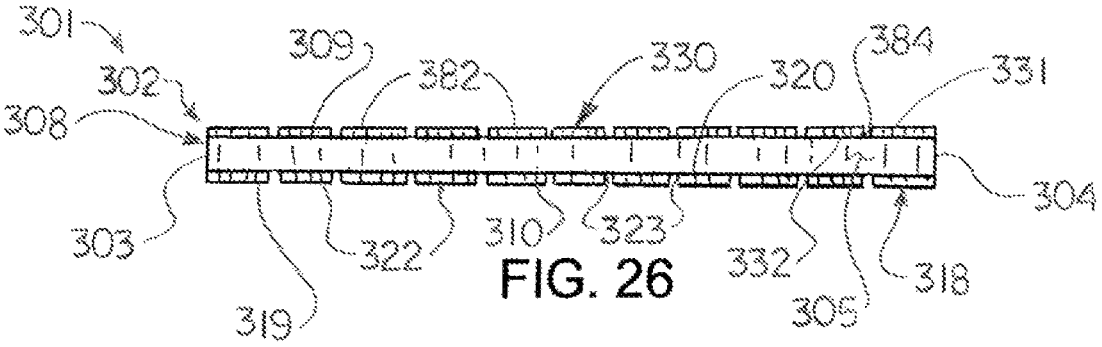
FIG. 26 is a side view of the runner member illustrated in FIGS. 23 and 24.

As illustrated in FIG. 24 the vehicle traction elements 382 on the vehicle traction surface 331 of each runner member 302 of the assembly 301 may include multiple, parallel, spaced-apart boards or slats. Vehicle traction gaps 384 may extend between the adjacent vehicle traction elements 382. As illustrated in FIG. 23, in like manner, the ground traction elements 322 of each ground traction element 322 may include multiple, parallel, spaced-apart boards or slats. Ground traction gaps 323 may extend between the adjacent ground traction elements 322. Each vehicle traction element 382 and each ground traction element 322 may include rubber, plastic, composite material, metal, wood, concrete, polycarbonate and/or other suitable durable material or materials known by those skilled in the art. The vehicle traction elements 382 with intervening vehicle traction gaps 384 may collectively form the vehicle traction panel 330 of each runner member 302.

Figure 27:
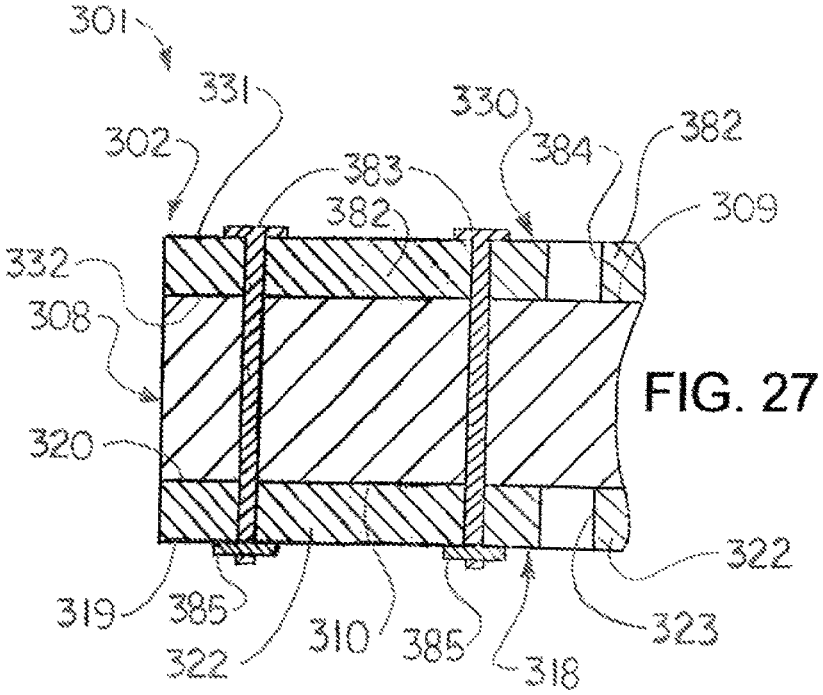
FIG. 27 is an enlarged sectional view, taken along section lines 27-27 in FIG. 25, of the runner member.

As illustrated in FIG. 27, in some embodiments, traction element fasteners 383 may attach each vehicle traction element 382 and each ground traction element 322 to the base panel 308. Each traction element fastener 383 may include a bolt which extends through registering bolt openings in the vehicle traction panel 330, the base panel 308 and the ground traction panel 318, respectively. A securing nut 385 may be threaded on each bolt.

Application of the assembly 301 may be as was heretofore described with respect to the assembly 1. As the vehicles 54 (FIGS. 1 and 2) traverse the assembly 301, the vehicle traction elements 382 impart traction between the vehicle wheels 55 and the runner member 302.

Figure 28:
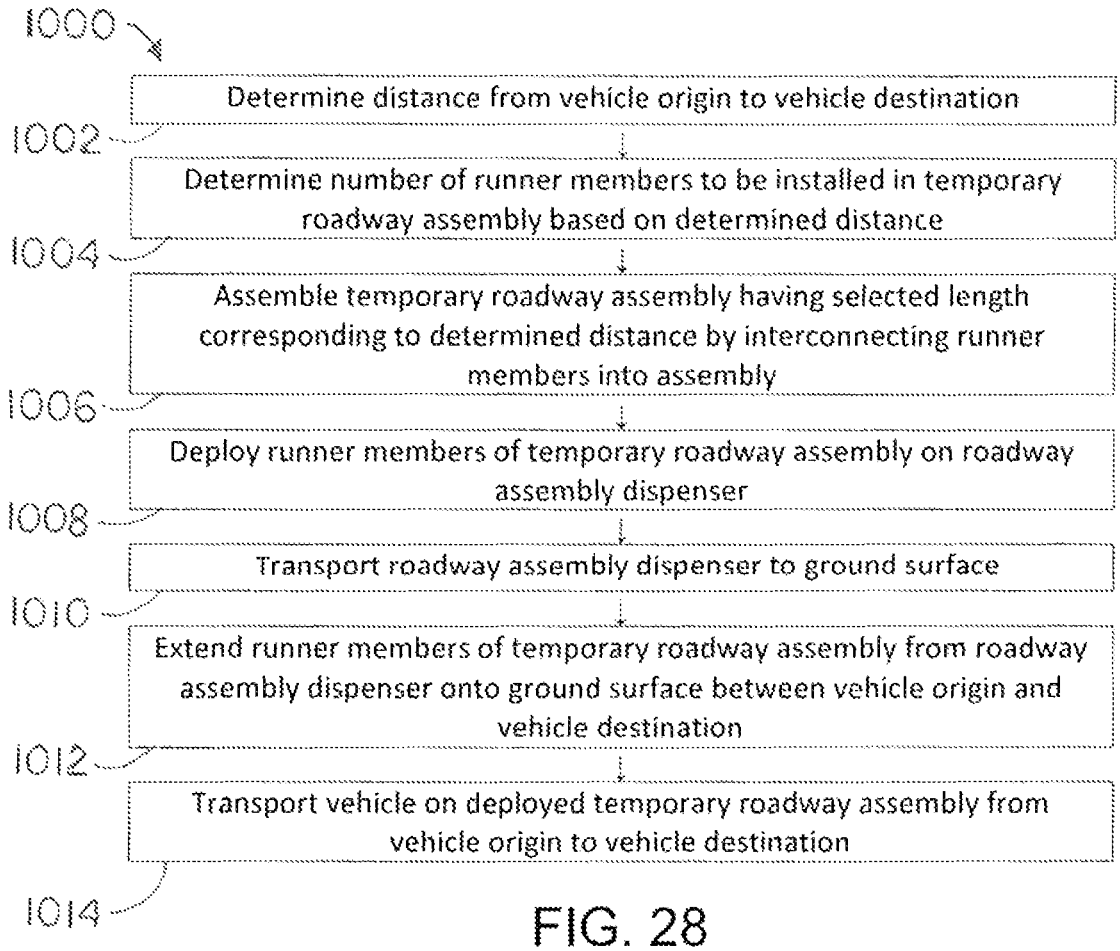
FIG. 28 is a flow diagram of an illustrative embodiment of the temporary roadway methods.

Referring next to FIG. 28 of the drawings, a flow diagram of an illustrative embodiment of the temporary roadway methods is generally indicated by reference numeral 1000. At Step 1002, the distance between a paved roadway or other vehicle origin to a mill, hydrocarbon wall or other vehicle destination may be determined or estimated (hereinafter determined distance).

At Step 1004, the number of runner members to be installed in the temporary roadway assembly may be determined based on the determined distance.

At Step 1006, the temporary roadway assembly having a selected length which corresponds to the determined distance may be assembled by interconnecting the runner members into the assembly. The temporary roadway assembly may be as was heretofore described with respect to the assembly 1 in FIGS. 1-12, the assembly 101 in FIGS. 13-17, the assembly 201 in FIGS. 18-22, or the assembly 301 in FIGS. 23-27. Accordingly, to the extent applicable, the same descriptions which were set forth hereinabove with respect to the respective assemblies 1, 101, 201 and 301 are incorporated by reference herein in their entireties with respect to the method 1000.

At Step 1008, the runner members of the temporary roadway assembly may be deployed on the roadway assembly dispenser. In some embodiments, this may be accomplished by rolling and winding the interconnected runner members on a dispenser spool of the roadway assembly dispenser.

At Step 1010, the roadway assembly dispenser and temporary roadway assembly may be transported to a ground surface.

At Step 1012, the runner members of the temporary roadway assembly may be unrolled or extended from the roadway assembly dispenser onto the ground surface. The deployed temporary roadway assembly may extend from the paved roadway or other vehicle origin to the mill, hydrocarbon well or other vehicle destination.

At Step 1014, the vehicles may be transported on the interconnected runner members of the temporary roadway assembly from the vehicle origin to the vehicle destination.

While certain illustrative embodiments of the disclosure have been described above, it will be recognized and understood that various modifications can be made to the embodiments and the appended claims are intended to cover all such modifications which may tall within the spirit and scope of the disclosure.

What is claimed is:

1. A temporary roadway assembly for deployment on a ground surface to support and provide traction to vehicles as the vehicles traverse the surface, the temporary roadway assembly comprising:

a plurality of flexible, resilient, bendable, and rollable runner members each comprising:

a base panel having a base panel outer surface and a base panel inner surface opposite the base panel outer surface;

a ground traction surface disposed at the base panel inner surface of the base panel;

at least one ground traction element at the ground traction surface, the at least one ground traction element configured to engage the ground surface and facilitate traction of each corresponding one of the plurality of runner members with respect to the ground surface;

a vehicle traction panel having a vehicle traction surface disposed at the base panel outer surface of the base panel and a vehicle traction panel inner surface opposite the vehicle traction surface, the vehicle traction panel inner surface attached to the base panel outer surface of the base panel;

at least one vehicle traction element at the vehicle traction surface of the vehicle traction panel, the at least one vehicle traction element configured to facilitate traction between vehicle wheels on the vehicles and each corresponding one of the plurality of runner members, the at least one vehicle traction element comprising a plurality of crisscrossing traction chains forming a traction chain lattice or meshwork in the vehicle traction panel, each of the plurality of crisscrossing traction chains including a plurality of linked traction chain links disposed in a taut configuration against the base panel outer surface of the base panel; and a plurality of flexible, elastic, or resilient runner member connectors configured to connect adjacent ones of the plurality of runner members.

2. The temporary roadway assembly of claim 1 wherein the base panel comprises rubber.

3. The temporary roadway assembly of claim 1 wherein the at least one ground traction element is at least one protrusion, chain, slat, plate, bar, or tube.

4. The temporary roadway assembly of claim 1 wherein each of the plurality of runner members has a first runner member end, a second runner member end opposite the first runner member end and a pair of runner member side edges extending from the first runner member end to the second runner member end, each of the plurality of runner members rollable from the first runner member end to the second runner member end, and wherein the at least one flexible, elastic, or resilient runner member connector connects the first runner member end of each of the plurality of runner members to the second runner member end of each adjacent one of the plurality of runner members.

5. The temporary roadway assembly of claim 1 wherein the at least one flexible, elastic, or resilient runner member connector comprises a connector tether extending from a first one of the adjacent ones of the plurality of runner members and a connector cable extending from a second one of the adjacent ones of the plurality of runner members, the connector tether engaging the connector cable.

6. The temporary roadway assembly of claim 5 wherein the connector tether comprises a tether chain extending from the first one of the adjacent ones of the plurality of runner members and a tether clip extending from the tether chain, the tether clip engaging the connector cable.

7. The temporary roadway assembly of claim 1 further comprising at least one roadway assembly dispenser, and wherein the plurality of runner members is selectively dispensable from the roadway assembly dispenser.

8. The temporary roadway assembly of claim 7 wherein the at least one roadway assembly dispenser comprises a dispenser base and a dispenser spool rotatably carried by the dispenser base, and the plurality of runner members is woundable on and unwoundable and extendable from the dispenser spool.

9. A temporary roadway assembly for deployment on a ground surface to support and provide traction to vehicles as the vehicles traverse the surface, the temporary roadway assembly comprising:

a plurality of interconnected rollable runner members each having a first runner member end, a second runner member end opposite the first runner member end and a pair of runner member side edges extending from the first runner member end to the second runner member end, each of the plurality of runner members rollable from the first runner member end to the second runner member end, each of the plurality of runner members comprising:

a base panel having a base panel outer surface and a base panel inner surface opposite the base panel outer surface;

a ground traction panel having a ground traction surface and a ground traction panel inner surface opposite the ground traction surface, the ground traction panel inner surface attached to the base panel inner surface of the base panel, the ground traction panel having at least one ground traction element at the ground traction surface, the at least one ground traction element configured to engage the ground surface and facilitate traction of the ground traction panel with respect to the ground surface; and a vehicle traction panel having a vehicle traction surface and a vehicle traction panel inner surface opposite the vehicle traction surface, the vehicle traction panel inner surface attached to the base panel outer surface of the base panel, the vehicle traction panel having a plurality of vehicle traction elements at the vehicle traction surface, the plurality of vehicle traction elements comprising a plurality of crisscrossing traction chains forming a traction chain lattice or meshwork in the vehicle traction panel, each of the plurality of crisscrossing traction chains including a plurality of linked traction chain links disposed in a taut configuration against the base panel outer surface of the base panel with periodic ones of the plurality of linked traction chain links forming connecting chain links connecting to the connecting chain links of others of the plurality of crisscrossing traction chains, the plurality of crisscrossing traction chains covering an entire area of the base panel outer surface from the first runner member end to the second runner member end and between the runner member side edges; and at least one flexible, elastic, or resilient runner member connector connecting the first runner member end of each of the plurality of rollable runner members to the second runner member end of each adjacent one of the plurality of rollable runner members.

10. The temporary roadway assembly of claim 9 wherein the base panel comprises rubber.

11. The temporary roadway assembly of claim 9 wherein the at least one ground traction element is at least one protrusion, chain, slat, plate, bar, or tube.

12. The temporary roadway assembly of claim 9 further comprising at least one roadway assembly dispenser, and wherein the plurality of runner members is selectively dispensable from the roadway assembly dispenser.

13. The temporary roadway assembly of claim 9 wherein the at least one roadway assembly dispenser comprises a dispenser base and a dispenser spool rotatably carried by the dispenser base, and the plurality of runner members is woundable on and unwoundable and extendable from the dispenser spool.

14. A method of facilitating transport of a vehicle on a ground surface, comprising:

obtaining a temporary roadway assembly comprising:

a plurality of flexible, resilient, bendable, and rollable runner members each comprising:

a base panel having a base panel outer surface and a base panel inner surface opposite the base panel outer surface;

a ground traction surface disposed at the base panel inner surface of the base panel;

at least one ground traction element at the ground traction surface, the at least one ground traction element configured to engage the ground surface and facilitate traction of each corresponding one of the plurality of runner members with respect to the ground surface;

a vehicle traction panel having a vehicle traction surface disposed at the base panel outer surface of the base panel and a vehicle traction panel inner surface opposite the vehicle traction surface, the vehicle traction panel inner surface attached to the base panel outer surface of the base panel;

at least one vehicle traction element at the vehicle traction surface of the vehicle traction panel, the at least one vehicle traction element configured to facilitate traction between vehicle wheels on the vehicles and each corresponding one of the plurality of runner members, the at least one vehicle traction element comprising a plurality of traction chains forming a traction chain lattice or meshwork in the vehicle traction panel each of the plurality of traction chains including a plurality of linked traction chain links disposed against the base panel outer surface of the base panel; and a plurality of flexible, elastic, or resilient runner member connectors configured to connect adjacent ones of the plurality of runner members;

rolling the plurality of runner members of the temporary roadway assembly on a roadway assembly dispenser;

transporting the roadway assembly dispenser to the ground surface;

unrolling the plurality of runner members of the temporary roadway assembly from the roadway assembly dispenser onto the ground surface; and transporting the vehicle on the plurality of runner members of the temporary roadway assembly.

15. The method of claim 14 wherein the at least one ground traction element is at least one protrusion, chain, slat, plate, bar, or tube.

16. The method of claim 14 wherein the at least one flexible, elastic, or resilient runner member connector comprises a connector tether extending from a first one of the adjacent ones of the plurality of rollable runner members and a connector cable extending from a second one of the adjacent ones of the plurality of rollable runner members, the connector tether engaging the connector cable, and wherein the connector tether comprises a tether chain extending from the first one of the adjacent ones of the plurality of rollable runner members and a tether clip extending from the tether chain, the tether clip engaging the connector cable.

* * * * *